United States Patent [19]

Maehara

[11] Patent Number: 4,722,755

[45] Date of Patent: Feb. 2, 1988

[54] HOT WORKING METHOD FOR SUPERPLASTIC DUPLEX PHASE STAINLESS STEEL

[75] Inventor: Yasuhiro Maehara, Kobe, Japan

[73] Assignee: Sumitomo Metal Industries, Ltd., Osaka, Japan

[21] Appl. No.: 802,747

[22] Filed: Nov. 29, 1985

[30] Foreign Application Priority Data

Mar. 15, 1985 [JP] Japan ..... 60-50542

[51] Int. Cl.[4] ..... C21D 7/14

[52] U.S. Cl. ..... 148/12 E; 148/12 EA; 148/325; 148/327; 420/902

[58] Field of Search ..... 148/12 E, 12 EA, 37, 148/38; 420/902

[56] References Cited

U.S. PATENT DOCUMENTS 4,390,367 6/1983 Niehaus et al. ..... 148/38

*Primary Examiner*—R. Dean

*Attorney, Agent, or Firm*—Burns, Doane, Swecker & Mathis

[57] ABSTRACT

A duplex $\alpha$ (ferrite) and $\gamma$ (austenite) phase stainless steel exhibiting superplasticity at high strain rate is disclosed. The steel comprises Fe, Cr, and Ni as primary elements, and N in an amount of 0.05–0.25%, preferably 0.1–0.2% by weight. The amount of Cr+Mo+1.5xSi is preferred to be substantially three times as much as that of $Ni+0.5\times Mn+30\times C+25\times N$. The disclosed steel shows good superplasticity in the temperature range of from 700° C. to the point 100° C. lower than the temperature at which the steel transforms into a single ferrite phase and at a strain rate of at least $1\times10^{-6}s^{-1}$ and less than $1\times10^{0}s^{-1}$, and can be elongated by more than 1000% at 900° C. and at a strain rate of $1.5\times10^{-2}s^{-1}$.

8 Claims, 2 Drawing Figures

HOT WORKING METHOD FOR SUPERPLASTIC DUPLEX PHASE STAINLESS STEEL

BACKGROUND OF THE INVENTION

1. Field of the Invention

The present invention relates to duplex phase stainless steels exhibiting superplasticity and to a hot working method thereof.

2. Prior Art

Generally, duplex phase stainless steels are utilized after being subjected to a solution treatment in the last production step thereof in which they are quenched after being heated to a temperature of from about 1000° to 1100° C. After the treatment, they exhibit two phases: $\alpha$ (ferrite) and $\gamma$ (austenite). The duplex stainless steels thus obtained are known to have superior strength, toughness, and weldability, as well as corrosion resistance. Thus, the demand therefor is increasing in various fields. Duplex steels, however, are difficult to work because of their duplex phase structure, and this difficulty in working has greatly limited their fields of application.

Research to develop processes for producing in greater quantities duplex stainless steels with the above-mentioned advantages have led to the adoption of a method of decreasing the content of impurities such as sulfur and oxygen which have harmful effects on hot working processes. This approach has enabled duplex stainless steels to be worked into articles of simple shapes such as pipes and plates or to be forged into articles of relatively simple shapes. The production of articles of more complicated shapes such as pipe joints and valves by hot working, however, is still extremely difficult. Thus, such articles of complicated shapes could only be manufactured by machining or casting processes which are low in efficiency and yield.

Recent rapid developements in the field of superplastic working processes have found application to duplex stainless steels as promising methods of working them into complicated shapes. Duplex stainless steels are already reported to exhibit certain degrees of superplasticity ranging from 400 to 500% [see, for example, G. I. Smith, B. Norgate and N. Redley, Met. Sci., 10 (1976), p. 182 et seq.]. The duplex stainless steels thus far known, however, show some superplasticity only under conditions of extremely low strain rate (from $10^{-4}$ to $10^{-5}\,s^{-1}$, for example). Thus, it has not been possible to efficiently apply superplastic working to duplex stainless steels under practical conditions for hot working.

SUMMARY OF THE INVENTION

Thus, an object of the present invention is to provide a duplex stainless steel which can be formed into complicated shapes only by a plastic hot working method, such as forging, bulging, drawing, or extrusion, and a method of hot wOrking thereof.

Another object of the present invention is to provide a duplex stainless steel capable of exhibiting enough superplasticity at a strain rate high enough for practical purposes and for the stable formation into arbitrary shapes, and also to provide a method of hot working thereof by which the duplex phase stainless steel of the present invention can be formed into arbitrary shapes by superplastic deformation at a strain rate which is sufficiently high for practical purposes.

The inventor of the present invention has sought a duplex stainless steel composition suitable for working by superplastic deformation. In the prior art, investigation on duplex stainless steels has been commonly carried out with materials having a decreased content of N in order to improve hot deformability or with materials to which a nitride-forming element such as Ti is added in order to fix the nitrogen value in the steel as nitrides.

The inventor has found that superplastic deformation of duplex stainless steels can be readily achieved when they contain a certain amount of N in solid solution (not fixed) and they are worked under specific deforming conditions.

The superplastic duplex stainless steel according to the present invention comprises iron (Fe), chromium (Cr), and nickel (Ni) as the primary constituent elements. The content of nitrogen in solid solution in the steel is from 0.05 to 0.25% by weight, and preferably from 0.1 to 0.2% by weight. The steel comprises two phases, i.e., an $\alpha$ (alpha) phase and a $\gamma$ (gamma) phase.

Thus, for a duplex stainless steel, the above steel composition has a relatively high N content, which is necessary for the steel to exhibit superplasticity at a relatively high strain rate. Any steel compositions falling within the range specified herein and which form $\alpha+\gamma$ duplex phases during superplastic deformation may be employed. Preferably, the proportions of $\alpha$ phase and $\gamma$ phase are almost equal to each other.

The preferable range of Ni and Cr contents are from 3 to 18% by weight and 15 to 35% by weight, respectively. Furthermore, the steel preferably comprises at least one of silicon (Si) and manganese (Mn) each in an amount of not more than 5% by weight. It is also preferred that the steel comprise at least one of the following elements in the range specified below by percent by weight:

molybdenum (Mo): 6% or less;
copper (Cu): 1% or less;
titanium (Ti): 0.5% or less;
zirconium (Zr): 0.5% or less;
niobium (Nb): 0.5% or less;
vanadium (V): 0.5% or less;
tungsten (W): 1.0% or less;
carbon (C): 0.1% or less.

The balance of the steel consists essentially of Fe and incidental impurities.

According to the hot working method of the present invention, the duplex stainless steel as defined above is heated to a temperature in the range of from 700° C. to a point 100° C. lower than the temperature at which the steel transforms into a single phase of ferrite ($\alpha$ phase), and is deformed at a strain rate of at least $1\times10^{-6}\,s^{-1}$, but less than $1\times10^{0}\,s^{-1}$. The preferred temperature range is from 800° to 1100° C., with a more preferred range being 900°-1000° C. It is further preferred that the strain rate be at least $10^{-4}\,s^{-1}$ and less than $10^{0}\,s^{-1}$, generally less than $10^{-1}\,s^{-1}$.

DETAILED DESCRIPTION OF THE PREFERRED EMBODIMENTS

Figure 1:
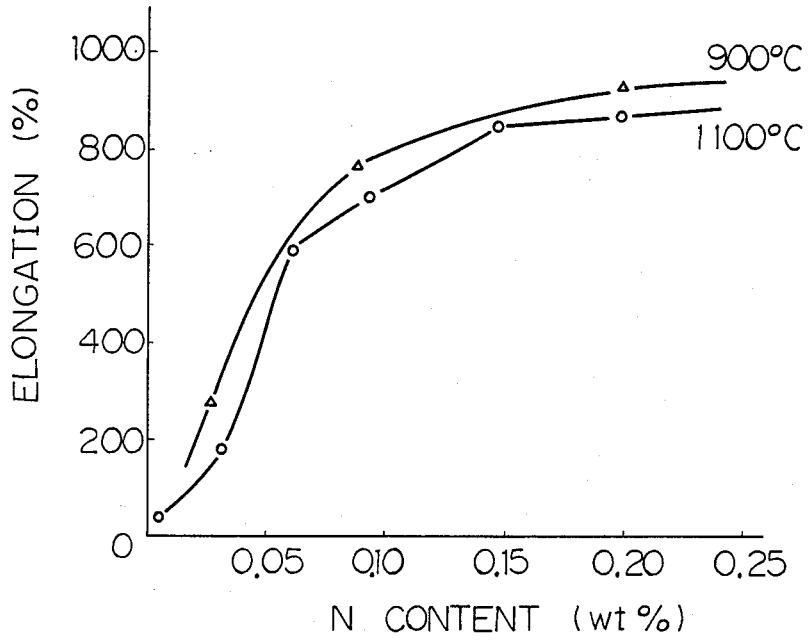
FIG. 1 shows a graph representing the relationship between the nitrogen content in solid solution in the stainless steel and the elongation when superplastic deformation is applied thereto.

First, the principles of the present invention, especially the reasons for the limitation of the composition of the steel and for the limitation of the conditions for hot working according to the present invention are explained in detail.

The duplex stainless steel according to the present invention is defined as comprising Fe, Cr, and Ni as the primary constituent elements. This is because steels comprising Fe, Cr, and Ni as the primary elements are advantageous with respect to the cost and the properties of the material, although other combinations of elements may also result in a mixed duplex phase microstructure of $\alpha$ and $\gamma$ phases. Preferably, the duplex stainless steel according to the present invention comprises Ni in an amount of from 4 to 18% by weight, and Cr in an amount of from 15 to 35% by weight. In addition, the steel comprises, if necessary, at least one of the following elements in the specified range on a weight basis:

Mo: not more than 6.0%,
Cu: not more than 1%,
Ti: not more than 0.5%,
Zr: not more than 0.5%,
Nb: not more than 0.5%,
V: not more than 0.5%,
W: not more than 1.0%, and
C: not more than 0.1%.

The steel according to the present invention may comprise at least one of Si and Mn, both of which may be present in an amount not exceeding 5% by weight. Furthermore, the steel of the present invention may comprise small amounts of rhenium (Re), cerium (Ce), or calcium (Ca), and incidental impurities.

It is further preferred that the steel of the present invention comprise Ni in an amount of from 3 to 9% by weight, Cr in an amount of from 17 to 27% by weight, Mo in an amount of from 1 to 4% by weight, and a small amount (from about 0.5 to about 1.5% by weight) of at least one deoxidizing element such as Si and Mn.

The amount of nitrogen in solid solution in the steel according to the present invention is limited to the range of from 0.05 to 0.25% by weight. The reason is that the superplasticity is not readily realized when the amount of nitrogen is less than 0.05% by weight, and that the addition of nitrogen in an amount exceeding 0.25% by weight is difficult in commercial operation. A preferred range for the amount of nitrogen in solid solution is from 0.1 to 0.2% by weight. A portion of N may be fixed as nitrides by the addition of a very small amount of one or more of Zr, Ti, Nb, and V, provided that the effective content of N in solid solution in the steel falls within the range specified above.

It is also preferred that the value of chromium equivalent (Cr eq) be about three times as much as that of nickel equivalent (Ni eq), so that the proportions of $\alpha$ and $\gamma$ phases are substantially the same at temperatures around 1000° C. which are usually employed in hot working. "Cr eq" and "Ni eq" are given by the following equations:

$$\text{Cr eq} = \text{Cr} + \text{Mo} + 1.5 \times \text{Si}$$

$$\text{Ni eq} = \text{Ni} + 0.5 \times \text{Mn} + 30 \times \text{C} + 25 \times \text{N}$$

The reason why the values of the chromium and nickel equivalents preferably satisfy the conditions specified above is that hot deformation is facilitated under such conditions, and also that such conditions enhance the properties of the products to be formed from the resulting steel.

The presence of nitrogen in an amount as specified above in solid solution in the steel according to the present invention has already been described as having advantageous effects on superplastic deformation. This is because with increasing amounts of carbon and nitrogen which are lighter elements among the $\gamma$ phase-forming elements such as Ni, Mn, C, and N, the dispersion and spheroidizing of the $\gamma$ phase during deformation are more facilitated with advantageous effects on the superplastic deformation, so long as the proportions of $\alpha$ and $\gamma$ phases are kept substantially equal in the steel. The presence of carbon in an increased amount, however, leads more readily to formation of carbides, which may adversely affect the properties of the products. Thus, the amount of carbon is preferred to be minimized, the specific preferred upper limit thereof being 0.05% by weight as mentioned above.

The superplastic deformation of the duplex steel according to the present invention is attainable mostly in the state of duplex phase of $\alpha$ and $\gamma$ phases, and is realized through processes including breaking, dispersion and spheroidizing of the relatively hard $\gamma$ phase in $\alpha$ phase, and the dynamic recrystallization of the relatively soft $\alpha$ phase during deformation. Thus, a relatively large amount of nitrogen in solid solution in the steel is an important factor for ensuring enough superplastic deformation under industrially practical conditions.

The superplastic deformation of the duplex stainless steel also occurs under the conditions in which $\sigma$ (sigma) phase precipitates during deformation in a low temperature range below 1000° C. In this case, a eutectic reaction in which $\alpha$ phase transforms into $\gamma$ and $\sigma$ phases occurs, so that the material gains ductility as a result of a kind of transformation superplasticity effect achieved by the reaction. In the duplex phase state of $\gamma+\sigma$ with the disappearance of $\alpha$ phase after the eutectic reaction, the relatively hard $\sigma$ phase in the relatively soft $\gamma$ phase undergoes the processes of dispersion and spheroidizing. The relatively soft $\gamma$ phase, on the other hand, undergoes the process of dynamic recrystallization just like the aforementioned $\alpha$ phase in the duplex phase of $\alpha+\gamma$, as the deformation of the steel proceeds A larger amount of a light $\gamma$ phase-forming element, e.g., nitrogen is also advantageous for the process of $\gamma$ phase recrystallization. When the precipitation of $\sigma$ phase is to be positively utilized, the aforementioned Cr eq is preferably not less than 25% by weight, and is approximately three times as much as Ni eq [Cr eq$\approx 3\times$(Ni eq)].

The duplex stainless steels of the composition which falls within the range as specified above are not necessarily in need of special pretreatments before the superplastic deformation. Therefore, the steels of the present invention are of high industrial or commercial value. For example, lumps of steel obtained by the conventional ingot making or continuous casting process and preformed into plates, bars, pipes, and other shapes by hot forging or hot rolling may be utilized as a starting material for the superplastic working process without further special treatment. It may be preferred in some instances, however, that after the preforming the material be water quenched, or subjected again to solution treatment, or slightly worked in a low temperature range of not higher than 700° C., which may have better effects on the subsequent superplastic working process.

According to the hot working process of the present invention, the temperature range employed in the superplastic deformation is defined to be not lower than 700° C., and not higher than 100° C. lower than the temperature at which the steel transforms into a single phase microstructure. If the temperature is below 700° C., thermal activation necessary for the aforementioned precipitation and recrystallization which is important to the occurrence of superplasticity is hindered, and enough superplasticity cannot be obtained. If, on the other hand, the temperature exceeds the above-mentioned upper limit, the amount of $\gamma$ phase becomes extremely reduced, so that the aforementioned effect of $\gamma$ phase as the second relatively hard phase cannot be expected. That is, the amount of $\gamma$ phase is not enough to be dispersed and spheroidized effectively in $\alpha$ phase, so that the process of recrystallization of $\alpha$ phase is not enhanced. The usual temperature at which the single $\alpha$ phase occurs is about from 1200° to 1350° C. Thus, the preferred temperature range of the superplastic deformation process is from 800° to 1100° C. A more preferred range is from 900° to 1000° C.

The strain rate of the steel during deformation is limited to the range of from $10^{-6}$ to $10^{0}$ per second. A range of $10^{-4}$ -$10^{0}$ per second is generally preferable. The reason for this limitation is that if the strain rate is outside this range, difficulty arises in obtaining superplasticity because of the low tendency of the occurence of the microstructural changes as described above during the deformation. The practically preferred range of the strain rate is from $10^{-4}$ to $10^{-1}$ per second. A further limited range is from $10^{-3}$ to $10^{-1}$ per second.

The hot working processes according to the present invention utilizing the superplasticity phenomenon include forging, bulging, wire drawing, extrusion, etc., which are effected under the conditions described above. The hot working process according to the present invention also include diffusion bonding utilizing superplasticity.

Post-treatments are generally not necessary for the products produced and worked according to the present invention. In some cases, pickling for removing scales or solution treatment for transforming the precipitated $\sigma$ phase, if any, may be necessary.

The articles produced according to the present invention have a very refined microstructure obtained by the process of superplastic deformation, so that the properties thereof are superior to those of the articles produced by conventional processes with respect to mechanical properties and corrosion resistance.

Next, examples of the steel and the working process thereof according to the present invention are described.

EXAMPLE

Ingots of 50 kg each were produced by melting steels of six different compositions in a high frequency furnace in the air in a laboratory. The steels comprised the following elements in the amounts specified below:

C: 0.02% by weight;
Si: 0.1% by weight;
Mn: 0.8% by weight;
P: 0.015% by weight;
S: 0.002% by weight;
Ni: from 3.5 to 10.75% by weight;
Cr: 25.0% by weight;
Mo: 3.0% by weight;
N: from 0 to 0.25% by weight.

The ingots were subjected to hot forging and hot rolling to produce round bars with a diameter of 10 mm, from which round tensile test bars or specimens having a parallel portion 5 mm in diameter and 20 mm in gauge length were obtained. The specimens were heated to various temperatures and were deformed under tensile loads to determine the relationship between the elongations and the working conditions.

FIG. 1 shows a result of such determination. The two curves in the graph of FIG. 1 represent the relationship between the elongations of the specimens (ordinate) and the nitrogen contents in solid solution in the steel of the specimens (abscissa) when they were deformed at a strain rate of $1\times10^{-2}$ $s^{-1}$ and at 900° and 1100° C., respectively.

As is apparent from FIG. 1, the elongation of the specimens due to superplastic deformation increased with increasing content of nitrogen in solid solution, showing the advantageous effect of the solid solution nitrogen thereon. The elongation due to superplastic deformation in conventional cases could at most be 500%. When the amount of nitrogen in solid solution was equal to or above 0.05% by weight, the elongations of the specimens were above the 500% level even at the lower temperature of 900° C. It should further be stressed that these values of the elongations of the specimens were obtained at a relatively high strain rate of $1\times10^{-2}$ per second. It was also noted that the variation of the Ni content in the above-indicated range did not result in significant differences in the values of elongations of the specimens.

Next, in order to evaluate the effects of temperature and strain rate during the working and deformation process, a steel of the following compositon was prepared:

C: 0.015% by weight;
Si: 0.2% by weight;
Mn: 0.85% by weight;
P: 0.014% by weight;
S: 0.003% by weight;
Ni: 6.54% by weight;
Cr: 25.2% by weight;
Mo: 3.0% by weight;
N: 0.15% by weight;
Fe: balance.

Specimens of this steel were prepared in the same manner as described above, and were subjected to a tensile test under different temperatures and strain rates to determine the relation between the elongations of the specimens and the conditions of deformation.

Figure 2:
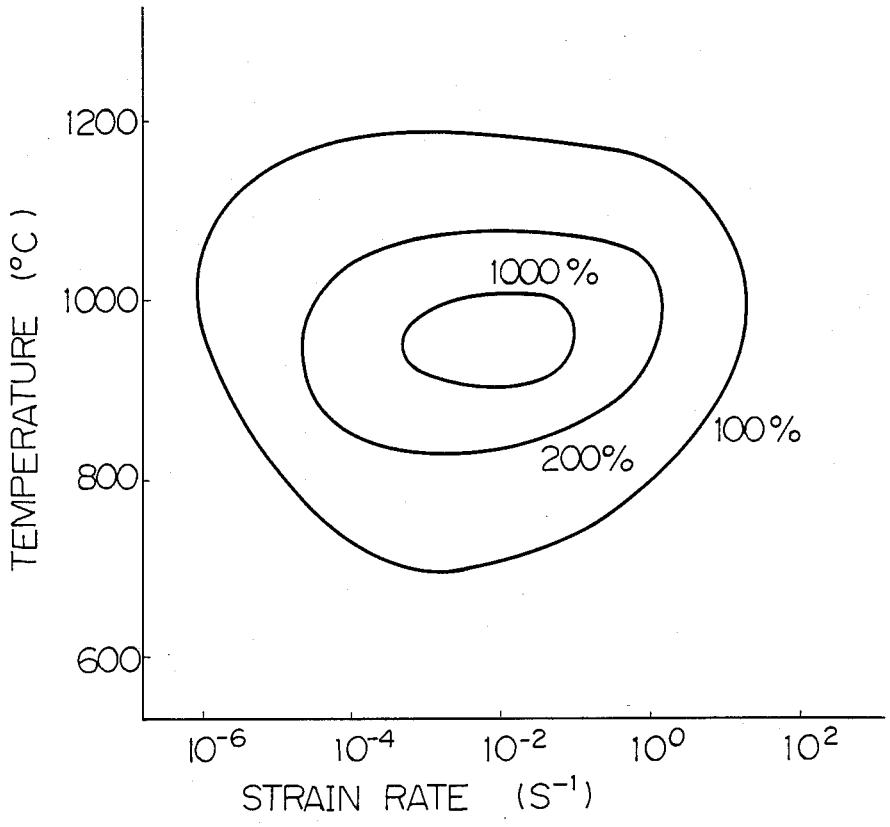
FIG. 2 is a graph showing the relationship between strain rate and temperature for various values of strain.

FIG. 2 shows a result of such an experiment. The three curves in the figure plot the relationship between strain rate and temperature for elongations of 100% (the outermost curve), 200% (the middle curve), and 1000% (the innermost curve), respectively, of specimens in the temperature-strain rate domain. The results of the experiment show that larger elongations can be obtained in a temperature range of from 700° to 1200° C. and with a strain rate of less than $10^{-1}$ per second. Furthermore, it is noted that under very advantageous conditions of working at 900° C. and at a strain rate of $1.5\times10^{-2}$ per second, a superplastic elongation of not less than 1000% is obtained. At a strain rate of $5\times10^{-3}$ per second, an elongation of greater than or equal to 2000% was observed, although not shown in FIG. 2.

Thus, the strain rate at which the steel exhibits superplasticity is extended to a higher strain rate range according to the present invention, which is very important for industrial hot working processes utilizing superplasticity. It is noted from FIG. 2 that it is advisable to carry out deformation at a strain rate of $10^{-3}$–$10^{-1}$ $s^{-1}$ at a temperature of 900°–1000° C.

It has been determined by microstructural observations after heat treatment that the steels according to the present invention have a single $\alpha$ phase microstructure when heated to 1350° C. and a duplex phase microstructure of $\alpha$ and $\gamma$ below this temperature.

Although the present invention has been described with respect to preferred embodiments, it is to be understood that variations and modifications may be employed without departing from the concept of the invention as defined in the following claims.

What is claimed is:

1. A method of imparting superplasticity to a duplex alpha (ferrite)+gamma (austenite) phase stainless steel comprising Fe, Cr, and Ni as primary constituent elements, which comprises incorporating nitrogen in solid solution in an amount of from 0.05 to 0.25% by weight and plastically deforming the steel by the steps of:

heating the steel at a temperature in the range of not lower than 700° C. and not higher than 100° C. below the temperature at which the steel transforms into a a single phase of ferrite structure; and deforming the steel at a strain rate of at least $1\times10^{-6}$ per second and less than $1\times10^{0}$ per second.

2. A hot working method as claimed in claim 1, wherein said temperature range is from 800° to 1100° C.

3. A hot working method as claimed in claim 1, wherein said temperature range is from 900° to 1000° C.

4. A hot working method as claimed in claim 1, wherein said strain rate is at least $10^{-4}$ per second and less than $10^{-1}$ per second.

5. A method of imparting superplasticity to a duplex alpha (ferrite) and gamma (austenite) phase stainless steel as claimed in claim 1 in which the steel comprises Ni in an amount of from 3 to 18% by weight, and Cr in an amount of from 15 to 35% weight.

6. A method of imparting superplasticity to a duplex alpha (ferrite) and gamma (austenite) phase stainless steel as claimed in claim 1 in which the amount of N in a solid solution in the steel is from 0.1 to 0.2% by weight.

7. A method of imparting superplasticity to a duplex alpha (ferrite) and gamma (austenite) phase stainless steel as claimed in claim 1 in which the steel comprises, on a weight basis, Ni: from 3 to 9%, Cr: from 17 to 27% by weight, and Mo: from 1 to 4%.

8. A method of imparting superplasticity to a duplex alpha (ferrite) and gamma (austenite) phase stainless steel as claimed in claim 1 in which the steel comprises, on a weight basis, Ni: from 3 to 18%, Cr: from 15 to 35% by weight, and N: in an amount within the specified range, and which further comprises at least one of Si: not more than 5% and Mn: not more than 5%, and at least one element selected from the group consisting of:

Mo: not more than 6.0%,
Cu: not more than 1%,
Ti: not more than 0.5%,
Zr: not more than 0.5%,
Nb: not more than 0.5%,
V: not more than 0.5%,
W: not more than 1.0%, and
C: not more than 0.1%, the balance being iron with incidental impurities.

* * * * *